United States Patent [19]

Clapp

[11] Patent Number: 4,653,354

[45] Date of Patent: Mar. 31, 1987

[54] BOTTLE OPENER

[75] Inventor: David D. Clapp, Newfields, N.H.

[73] Assignee: The Wakefield Corporation, Wakefield, Mass.

[21] Appl. No.: 703,271

[22] Filed: Feb. 20, 1985

[51] Int. Cl.[4] ..... B21K 21/00

[52] U.S. Cl. ..... 76/101 D; 76/101 R; 76/104 R

[58] Field of Search ..... 76/101 D, 104 R, 101 R

[56] References Cited

U.S. PATENT DOCUMENTS 2,275,420 3/1942 Clark et al. ..... 76/101 R

OTHER PUBLICATIONS

Goetzel, "Treatise on Powder Metallurgy", vol. I, 1949, pp. 302, 235, 591, 625, 702, 705, 707, 310, 212, 213, 71 and Chapter X.

*Primary Examiner*—Frederick R. Schmidt
*Assistant Examiner*—Maurina Rachuba

[57] ABSTRACT

A bottle opener having a handle and a pair of extending fingers, the opener being made of powdered metal by compressing the powder in a die and sintering the compressed powder at a high heat to bond the particles together, whereby the resulting bottle opener is strong, does not wear easily and is not expensive to fabricate.

10 Claims, 3 Drawing Figures

BOTTLE OPENER

FIELD OF THE INVENTION

This invention relates to bottle openers, and in particular, a method for making them.

BACKGROUND OF THE INVENTION

Despite the widespread existence of cans and bottles with self-opening tops, there is still a need for conventional bottle openers, particularly in restaurants and other commercial establishments. Many such bottle openers today are made of aluminum. Unfortunately, aluminum is relatively soft, and these bottle openers dent and wear down with use. Harder materials such as steel may be used to overcome these problems, but such bottle openers are considerably more expensive to fabricate. Accordingly, there is a need for a bottle opener which is strong enough that it is not susceptible to denting and resistant to wear, but which at the same time can be fabricated inexpensively.

SUMMARY OF THE INVENTION

I have discovered a new bottle opener and a method of making it, the bottle opener having a pair of fingers for grasping a bottle top and an extending handle for leverage in lifting the top, the opener being made of powdered metal which is sintered so that the bottle opener has considerable strength and wears well but is inexpensive to manufacture.

In the preferred embodiment, the bottle opener has a first finger adapted to fit over the top of a bottle cap. A second finger is disposed apart from the first finger so as to form a space therebetween. A handle extends from the fingers so that in operation, the fingers grasp the bottle cap and the upward movement of the handle (which acts as a lever) causes the fingers to remove the cap. The bottle opener is made from metal alloy powder which is pressed into the form of the opener and then sintered. The opener is then impregnated with a resin prior to polishing and plating, and the resulting opener is very strong.

DESCRIPTION OF THE PREFERRED EMBODIMENT

I turn now to a description of the preferred embodiment, after first briefly describing the drawings.

DRAWINGS

STRUCTURE AND OPERATION

Figure 1:
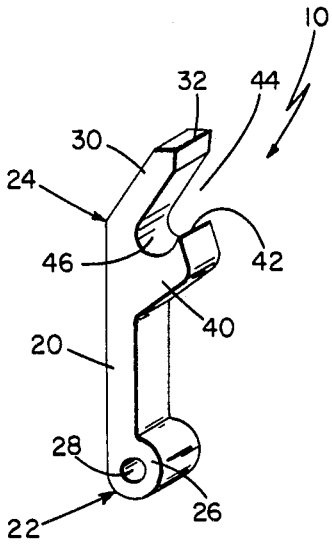
FIG. 1 is a perspective view of the bottle opener of this invention.
Figure 2:
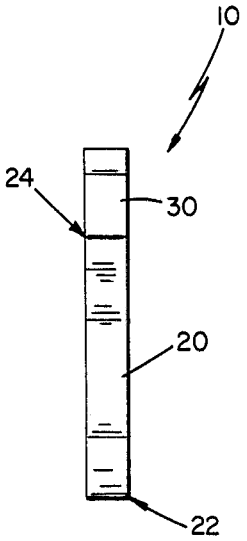
FIG. 2 is a top view of the bottle opener of this invention.

Referring to FIGS. 1 and 2, a bottle opener according to the invention is shown at 10. The bottle opener 10 has a handle 20, a first finger 30 and a second finger 40.

As shown in the Figures, the handle 20, which is about 1½ inches long in the preferred embodiment, has a first end 22 and a second end 24. A rounded cylinder 26 is disposed at the first end 22. The cylinder 26 has a hole 28 therethrough to support a chain (not shown) or other similar holding means. Of course, alternatively, the handle 20 could be made longer so that a chain is not needed.

The first finger 30 extends from the second end 24 of the handle 20 opposite the cylinder 26 at an angle of about 45°. The first finger 30 is about ½ inches long, and it has a pointed tip 32 opposite the handle 20. Second finger 40 is slightly shorter than the first finger 30. Second finger 40 also extends from the handle 20 at an angle of about 45°. The end of the second finger 40 forms a point 42 disposed in the direction of the first finger 30. The fingers 30, 40 are separated by bottle cap opening 44, which is defined by a curved surface 46 extending between the fingers 30, 40.

Figure 3:
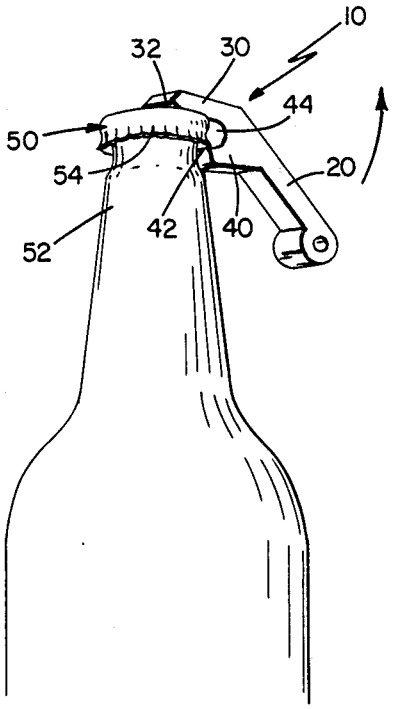
FIG. 3 is a perspective view of the bottle opener of this invention in use.

As shown in FIG. 3, the bottle opener 10 operates in the following manner. The bottle opener 10 is placed so that a cap 50 on a bottle 52 fits in the opening 44 between the fingers 30, 40. The first finger 30 is disposed across the top of the cap 50 while the point 42 of the second finger 40 is disposed below an apron 54 of the cap. The handle 20 extends generally downward from the cap at an angle of about 45°. The cap 50 is removed by moving the handle 20 upwardly as shown. When this movement is made, the second finger 40 lifts the apron 54 and bends the cap 50 as the first finger 30 holds the opposite side of the cap in place.

The bottle opener 10 of this invention is made in the following manner. In the preferred embodiment, the nickle steel powder is used, and it has the following composition.

Ni—4%
C—0.75%
Cu—0.50%
Fe—94.75%

Such a powder conforms to Metal Powder Industries Federation Specification 35-Alloy FN0408, and is available from Hoeganes Corporation of Riverton, N.J. Other powder, however, could be used.

The powder is placed in a die in the shape of the bottle opener 10 (the opener is made in a single piece). Such a die, not shown, may be fabricated by Monarch Tool & Gauge Company of Southfield, Mich. Once in the die, the powder is pressed at 25 tons per square inch. The part is compressed to a density of 6.6 grams per cubic inch (for a total weight of 14 grams in the preferred embodiment). A Kux Machine Company 125 Ton Press (Model 1100) may be used for this step.

Next, the pressed part is heat treated or sintered to bond the particles together. Initially, the pressed bottle opener is preheated to 1200° F. for ninteen minutes, after which it is sintered at 2040° F. for thirty minutes. The part is then cooled to room temperature over a period of fifty-one minutes. The preheating, sintering and cooling is all done in a protective atmosphere of nitrogen at a dewpoint of −27° F. A Model BAC-PH-M-F furnace fron C. I. Hayes Belt Furnace Company can be used for the sintering operation.

After sintering process is complete, the part is resin impregnated to cure any porosity. The resin impregnation is done under vacuum (according to Military Specification Mil. St. 276) with RC-2 Resin from Impco of Providence, R.I.

The bottle opener is then prepared for plating by first deburring and polishing. This is accomplished by tumbling the part in a 3 cubic foot Sweeco Model FM-3 Tumbler. A tetrahedran plastic media (#HD-1¼ inch × ¼ inch × ¼ inch) is used with a FMF2926 soap flow through. The tumbling is done for two hours.

Finally, the plating is done conventionally with white tin (imitation rhodium) plate on nickel plate. The result is a very durable bottle opener which is not expensive to fabricate.

Other variations will occur to those skilled in the art.

What I claim is:

1. A method of making a bottle opener comprising;

placing a metal powder with an iron base in a die in the form of the bottle opener, compressing the metal powder in the die with a high pressure;

sintering the compressed metal powder by first preheating the compressed metal powder at a high first temperature for a first period and then at the end of that first period without any intermediate steps further heating the compressed metal powder for a second period at a second temperature which is higher than the high first temperature so as to solidify the bottle opener;

cooling the sintered metal powder bottle opener;

impregnating the cooled metal powder bottle opener with a resin, and removing burrs and extra material from the bottle opener.

2. The method of claim 1 wherein said compressing is done at 25 tons per square inch.

3. The method of claim 1 wherein said compressing results in the compressed powder having a density of 6.6 grams per cubic centimeter.

4. The method of claim 1 wherein said metal powder is nickel steel with a nickel content of about 4%.

5. The method of claim 1 wherien said preheating is done at 1200° F. for about nineteen minutes.

6. The method of claim 1 wherein said heating is done at 2040° F. for about thirty minutes.

7. The method of claim 1 wherein said sintering is done in a protected atmosphere of nitrogen at a dew-point of −27° F.

8. The method of claim 1 wherein said removing comprises tumbling the bottle opener after said sintering.

9. The method of claim 1 further comprising plating the bottle opener after said sintering.

10. The method of claim 9 wherein said plating is done with white tin plate.

* * * * *